United States Patent [19]

Deering, Jr.

[11] 4,059,210

[45] Nov. 22, 1977

[54] TAPE DISPENSER

[75] Inventor: Hartland W. Deering, Jr., St. Paul, Minn.

[73] Assignee: Minnesota Mining and Manufacturing Company, St. Paul, Minn.

[21] Appl. No.: 757,937

[22] Filed: Jan. 10, 1977

[51] Int. Cl.[2] ..... B26F 3/02

[52] U.S. Cl. ..... 225/47; 225/80; 242/55.53

[58] Field of Search ..... 225/47, 46, 80; 242/55.2, 55.53

[56] References Cited

U.S. PATENT DOCUMENTS

| | | | |
|---|---|---|---|
| 3,291,411 | 12/1966 | Krueger et al. | 242/55.53 |
| 3,403,869 | 10/1968 | Marchisen et al. | 242/55.53 |

*Primary Examiner*—J. M. Meister

*Attorney, Agent, or Firm*—Cruzan Alexander; Donald M. Sell; William L. Huebsch

[57] ABSTRACT

A dispenser for one or more rolls of pressure sensitive adhesive coated tape. The dispenser includes a core support having an arcuate surface adapted to support the rolls of tape for rotation about the surface. The core support is fixed at one end to a radially projecting member slidably mounted on a base for the dispenser to afford manual movement of the core support between a dispense position at which a roll of tape is retained around the core support by walls of the dispenser adjacent the side surfaces of the roll of tape as tape is pulled from the roll; and a load position at which empty cores can be removed and full rolls of tape applied over an unrestricted end of the core support.

5 Claims, 7 Drawing Figures

TAPE DISPENSER

BACKGROUND OF THE INVENTION

This invention relates to tape dispensers, particularly to the means by which a roll of tape is rotatably supported in a tape dispenser and the means by which a roll of tape is loaded into the tape dispenser and an empty tape core is removed.

One common prior art type of tape dispenser comprises a weighted base adapted to be supported on the top surface of a desk or table, and a spool removably mounted on the base about which spool the roll of tape is supported. In the most common version of the dispenser the spool is adapted to frictionally engage an inner cylindrical surface on a core of a roll of tape and is rotatably mounted on the base, however non-rotatable spools have also been used in such a dispenser to support the tape for rotation about the outer surface of the spool. Either type of spool is normally mounted on the base so that an arcuate portion of the roll of tape is received in a cavity defined by walls of the base. The base also supports a cutting edge spaced from the spool on which tape withdrawn from the roll may be severed at a predetermined distance from the spool, and a tacking surface adjacent the cutting edge and between the cutting edge and the spool on which the tape may be temporarily adhered, thereby suspending a length of tape between the spool and tacking surface which can be easily grasped to withdraw the next length of tape from the roll.

While such dispensers have proved very serviceable, they have caused some inconveniences. When attempting to place a new roll of tape in the dispenser, users sometimes discard the removable hub with the core from an exhausted roll of tape. This causes the inconvenience of retrieving the hub, or, if the hub is not retrievable, disables the dispenser. Even if the hub is not discarded, to load the dispenser the hub must be totally separated from the base, inserted in the core of a roll of tape, and the roll and hub assembly mounted back on the base. This loading procedure is not as convenient as may be desired.

SUMMARY OF THE INVENTION

The present invention provides an improved means of supporting tape in a dispenser which allows easy replacement of tape without totally detaching a portion of the dispenser from its base.

According to the present invention there is provided an improved dispenser of the known type comprising a base having walls defining a cavity adapted to receive a portion of a roll of tape, means mounted on the base adapted for rotatably supporting the roll of tape in a dispense position with a portion of the tape in the cavity, means mounted on the base for severing tape pulled from the roll, and a surface adjacent the severing means on which an end of the tape may be releasably adhered. In the dispenser according to the present invention, the means adapted for rotatably supporting the roll of tape is a core support having an arcuate peripheral surface with a radius which is smaller than the radius of the inner surface of the core in the roll of tape to afford free rotation of the core about the peripheral surface. A radially extending slide member is fixed at one end of the core support and is slidably mounted on the base to fix the core support against rotation relative to the base and restrict separation of the core support from the base, while affording movement of the core support between (1) the dispense position at which surfaces of the walls defining the cavity in the base limit axial movement of the roll on the core support, and (2) a load position at which the core support is spaced away from the base in a position affording installation or removal of a roll of tape over a distal end of the core support.

BRIEF DESCRIPTION OF THE DRAWING

The dispenser will be further described with reference to the accompanying drawing wherein like numbers refer to like parts in the several views and wherein.

DESCRIPTION OF THE PREFERRED EMBODIMENT

Figure 1:
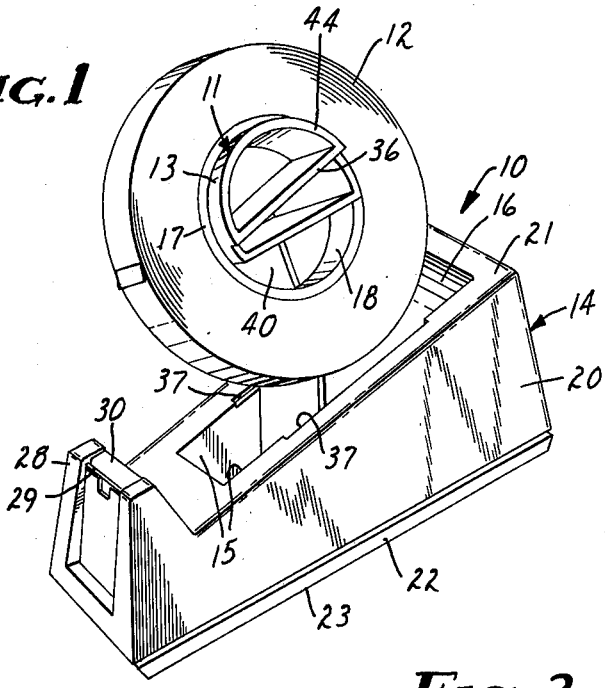
FIG. 1 is a perspective view of a tape dispenser according to the present invention in which a tape core support for the dispenser is in a load position.
Figure 7:
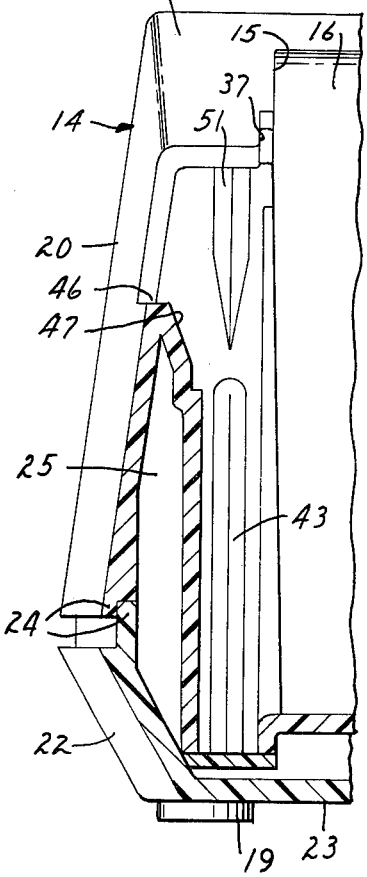
FIG. 7 is an enlarged fragmentary sectional view taken approximately along line 7—7 of FIG. 3.
Figure 2:
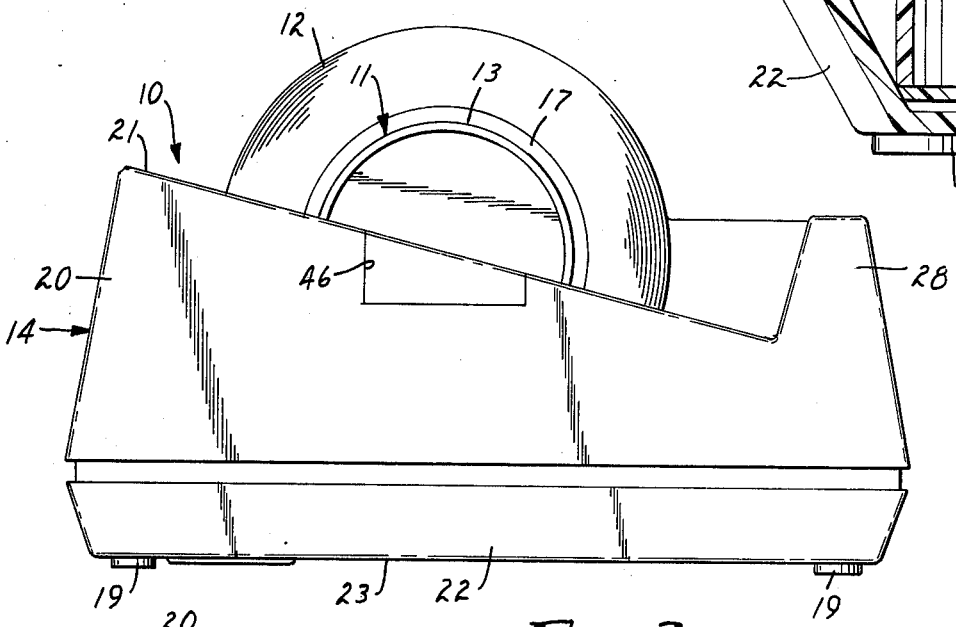
FIG. 2 is an enlarged side view of the dispenser of FIG. 1 in which the tape core support is in a dispense position.
Figure 3:
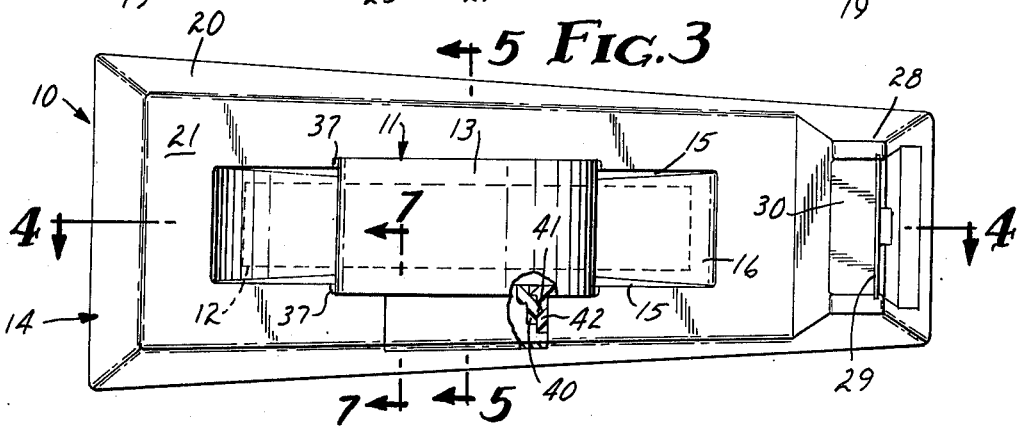
FIG. 3 is an enlarged top view of the dispenser as shown in FIG. 2 with parts broken away to show details.
Figure 4:
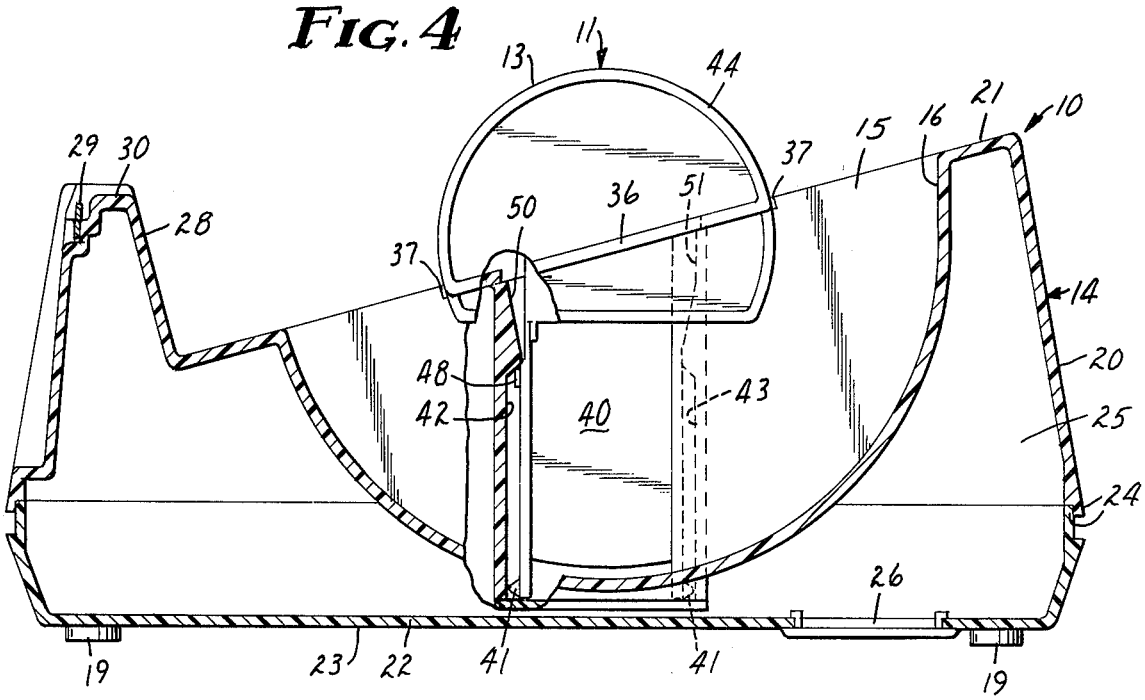
FIG. 4 is an enlarged sectional view taken approximately along line 4—4 of FIG. 3.
Figure 5:
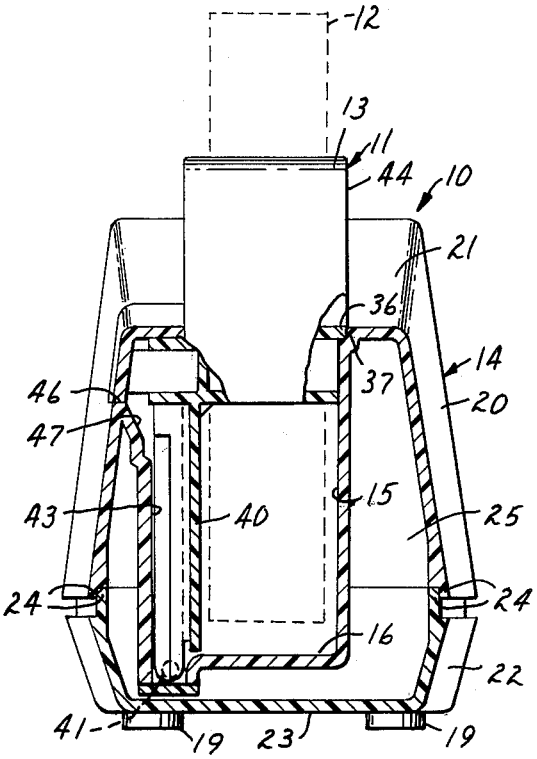
FIG. 5 is an enlarged sectional view taken approximately along line 5—5 of FIG. 3.
Figure 6:
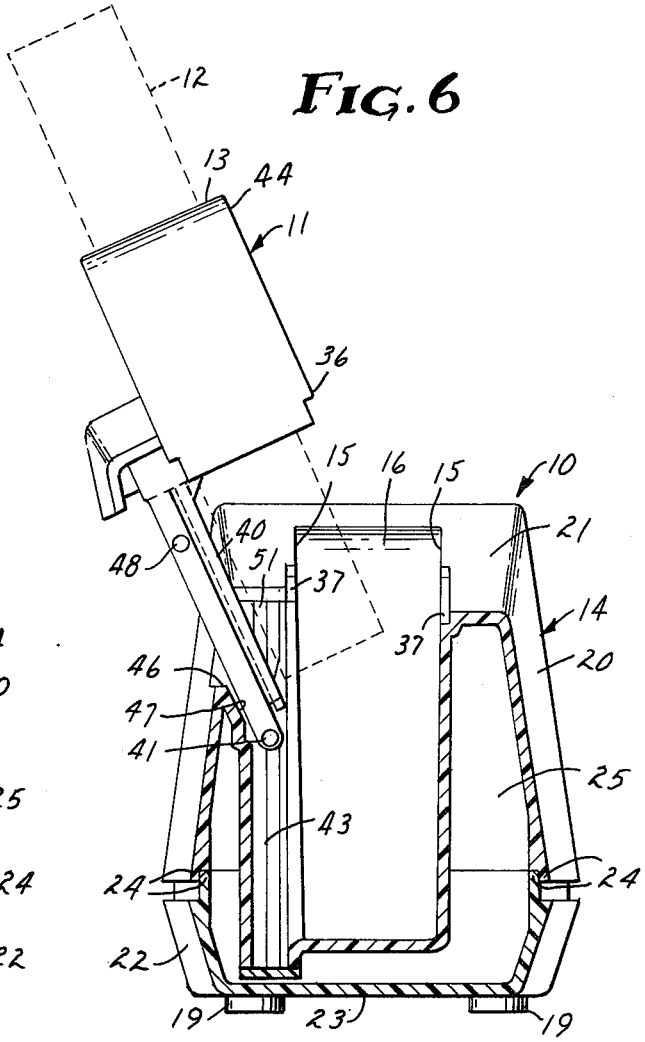
FIG. 6 is an enlarged sectional view also taken approximately along line 5—5 of FIG. 3, but in which the core support of the dispenser is in its load position.

Referring now to the drawing there is illustrated a dispenser 10 according to the present invention including a core support 11 having an arcuate peripheral surface 13 fixed relative to a base 14 for the dispenser 10, about which arcuate surface 13 one or more rolls of pressure sensitive adhesive tape 12 may be rotatably supported. Means are provided mounting the core support 11 for movement relative to the base 14 between a dispense position (FIGS. 2 through 5) at which a roll of tape will be retained around the core support 11 between walls 15 defining a cavity 16 in the dispenser 10 to afford removal of a predetermined length of the tape; and a load position (FIGS. 1 and 6) at which an empty core may be removed from a distal end of the core support 11 and/or a new roll of tape 12 mounted thereon. The rolls of tape which the dispenser is adapted to support are of the commercially available type comprising a length of tape helically wound on a core 17, which core 17 has a through cylindrical opening (e.g. 1 or 3 inch in diameter) defined by a cylindrical inner surface 18 of the core 17.

The base 14 of the dispenser is decoratively shaped and is supported on four resilient pads 19. The base 14 comprises a molded top portion 20 providing a top surface 21 for the dispenser 10, and a molded bottom portion 22 providing an opposite bottom surface 23. These top and bottom portions 20 and 22 have walls bonded at mating overlapping lips 24 to form a cavity 25 within the base which (via a plugged opening 26) is filled with a dense material which is not illustrated (e.g. silica sand). The dense material provides a desired weight for the dispenser 10 so that the dispenser 10 will not be drawn along a surface suporting it when the tape is withdrawn from the roll 12.

The top portion 20 of the base 14 includes a projection 28 on which is mounted a serrated knife blade 29 adapted to sever tape withdrawn from the roll of tape 12, and which provides a tacking surface 30 between the knife blade 29 and the roll of tape 12 on which the end of the tape may be releasably adhered.

The radius of the arcuate peripheral surface 13 is only slightly smaller than the radius of the inner surface 18 of the roll of tape 12 for which the dispenser is designed (e.g. about 0.015 inch less for cores with three inch diameter openings). This clearance affords free rotation of the core 17 about the arcuate surface 13. The arcuate surface 13 is adapted to extend for more than 180° and preferably over 230° along the inner surface 18 of the core 17 to insure generally coaxial location and rotation of the core 17 about the arcuate surface 13. In its dispense position the core support 11 is partially located between the two opposed walls 15 of the top portion 20 of the base 14 which walls 15 help define the cavity 16 adapted to receive an arcuate portion of the roll of tape 12 about the core support 11, with the edges 36 of a radial flange on the core support 11 supported in elongate notches 37 in the walls 15 adjacent the top surface 21 of the base 14. The arcuate surface 13 extends axially between the opposed walls 15 defining the cavity 16 which are disposed adjacent the side surfaces of the roll of tape 12 on the core support 11 with a portion (i.e. about one half) of the roll of tape 12 on the core support between the walls 15 so that the opposed walls 15 limit axial movement of the roll of tape 12 along the arcuate surface 13.

The means mounting the core support 11 for movement between its dispense position and its load position is best seen in FIGS. 3 through 7. A slide member 40 is fixed to one end of the core support 11. The slide member 40 is an elongate structure extending radially at generally at right angle to the axis of the arcuate surface 13. At the end of the slide member 40 opposite the core support 11 are opposed outwardly extending conical projections 41 disposed generally at right angles to the axis of the arcuate surface 13. The walls of the top portion 20 defined opposed V-shaped channels 42 and 43 spaced to recieve and guide the conical projections 41 to afford linear sliding movement of the slide member 40 with the core support 11 between the dispense position of the core support 11 at which the conical projections 41 are at the ends of the channels 42 and 43 adjacent the bottom surface 23 of the dispenser 10, and a position with the conical projections 41 at the end of the channels 42 and 43 adjacent the top surface 21 of the dispenser 10, thereby affording movement of the core support 11 to a position with the core support 11 spaced from the top surface 21 of the dispenser 10 to afford removal or application of one or more rolls of tape over a distal end 44 of the core support 11.

The walls of the top portion 20 define a slot 46 between the channels 42 and 43 adjacent the top surface 21 of the dispenser 10 into which the slide member 40 may pivot on the conical projections 41 after the conical projections 41 reach the ends of the channels 42 and 43 adjacent the top surface 21 of the dispenser 10. One wall defining the slot 46 provides a stop surface 47 disposed to limit such pivotal motion at a predetermined angle (e.g. 22° from vertical for the slide member 40). Pivoting the slide member 40 to that angle both provides better clearance to apply a full roll of tape over the distal end 44 of the core support 11, and insures that the core support 11 will be maintained in its load position until a user position a roll or rolls of tape on the arcuate surface and again manually aligns the slide member with the channels 42 and 43.

The dispenser also includes means for detenting the core support 11 at its dispense position to prevent the core support 11 from being moved toward its load position when tape is pulled from the roll. The detent means includes a truncated conical button 48 on the end of the slide member 40 adjacent the core support 11. The button 48 is positioned to just enter the end of the adjacent channel 42 when the core support 11 is manually moved to its dispense position and is guided into the channel 42 by a generally V-shaped groove 50 in a wall of the top portion 20 which groove 50 is aligned with the channel 42 and decreases in depth from the top surface 20 of the base 14 to the adjacent end of the channel 42. The surface of the wall defining the V-shaped groove 50 acts as a cam surface against the button 48 to deflect a rib-like portion of the slide member 40 supporting the button 48 as the core support 11 is pressed into the base 14 toward its dispense position where the rib-like portion of the slide member 40 will return to its original shape to releasably retain the button 48 in the end of the channel 42.

A V-shaped groove 51 of decreasing depth is also formed in the wall opposite the groove 50. The groove 51 also decreases in depth from the top surface 21 of the base 14 and is aligned with the channel 43 so that the opposed V-shaped grooves 50 and 51 serve to guide the conical projections 41 into the channels 42 and 43 when the core support 11 and slide member 40 are assembled into the base 14, as during initial assembly of the dispenser 10, or after they have become separated as by dropping the dispenser 10.

I claim:

1. In a dispenser for a roll of tape comprising a length of tape helically wound on a core which core has a central opening defined by a cylindrical inner surface, said dispenser being of the type comprising a base having walls defining a cavity adapted to receive a portion of a said roll of tape, means mounted on said base adapted for rotatably supporting the roll of tape in a dispense position with a portion of the tape roll in said cavity and means mounted on said base for severing tape pulled from said roll, the improvement wherein said means adapted for rotatably supporting the roll of tape is a core support having an arcuate peripheral surface with a radius which is smaller than the radius of the inner surface of a said core to afford free rotation of the core about said peripheral surface, a slide member fixed at one end of said core support and slidably mounted on said base to prevent rotation of said core support relative to said base, to restrict separation of said core support from said base, and to afford movement of said core support between said dispense position at which surfaces of the walls defining said cavity limit axial movement of the roll of tape about the core support and a load position at which the core support is spaced away from the base in a position affording installation or removal of a roll of tape over an end of said core support.

2. A dispenser according to claim 1, further including detent means for releasably retaining said core support in said dispense position.

3. In a dispenser for a roll of tape comprising a length of tape helically wound on a core, which core has a central opening defined by a cylindrical inner surface, said dispenser being of the type comprising a base having walls defining a cavity adapted to receive a portion of a said roll of tape, means mounted on said base adapted for rotatably supporting the roll of tape in a dispense position with a portion of the tape roll in said cavity and means mounted on said base for severing tape pulled from said roll, the improvement wherein said means adapted for rotatably supporting the roll of tape is a core support having an arcuate peripheral surface with a radius which is smaller than the radius of the inner surface of a said core to afford free rotation of the core about said peripheral surface, a slide member fixed at one end of said core support, and means for mounting said slide member on said base to prevent rotation of said core support relative to said base, to restrict separation of said core support from said base, and to afford movement of said core support between said dispense position at which surfaces of the walls defining said cavity limit axial movement of the roll of tape about the core support and a load position at which the core support is spaced away from the walls of said dispenser defining said cavity and is inclined at an acute angle with respect to said predetermined axis with the distal end of said core support facing away from the apex of said angle in a position affording installation or removal of a roll of tape over said distal end of the core support.

4. A dispenser according to claim 3, wherein said slide member has opposed members projecting outwardly in opposite directions at right angles to the axis of said arcuate peripheral surface, the walls of said base define opposed channels which receive said projections and guide said slide member to afford linear sliding movement of said slide member between said dispense position and an intermediate position with the axis of the arcuate peripheral surface parallel with said axis at said dispense position and said arcuate peripheral surface spaced from the walls of said dispenser defining said cavity, and said walls are shaped to afford pivotal motion of said slide member about said projections at said intermediate position to move said core support between said intermediate position and said load position.

5. A dispenser according to claim 3, further including detent means for releasably retaining said core support in said dispense position.

* * * * *